US008773468B1

(12) United States Patent
Ballagh et al.

(10) Patent No.: US 8,773,468 B1
(45) Date of Patent: Jul. 8, 2014

(54) SYSTEM AND METHOD FOR INTUITIVE MANIPULATION OF THE LAYERING ORDER OF GRAPHICS OBJECTS

(75) Inventors: Jonathan Ballagh, Boulder, CO (US); Roger B. Milne, Boulder, CO (US); Sean A. Kelly, Boulder, CO (US); William M. Troxel, Broomfield, CO (US); Jeffrey C. Ward, Arvada, CO (US)

(73) Assignee: Disney Enterprises, Inc., Burbank, CA (US)

( * ) Notice: Subject to any disclaimer, the term of this patent is extended or adjusted under 35 U.S.C. 154(b) by 253 days.

(21) Appl. No.: 12/870,659

(22) Filed: Aug. 27, 2010

(51) Int. Cl.
*G09G 5/00* (2006.01)

(52) U.S. Cl.
USPC ..... 345/634

(58) Field of Classification Search
USPC ..... 345/634
See application file for complete search history.

(56) References Cited

U.S. PATENT DOCUMENTS

| | | | | |
|---|---|---|---|---|
| 7,663,620 | B2 * | 2/2010 | Robertson et al. | 345/419 |
| 7,747,077 | B2 * | 6/2010 | Murakami | 382/180 |
| 8,091,030 | B1 * | 1/2012 | Ballagh et al. | 715/738 |
| 8,209,628 | B1 * | 6/2012 | Davidson | 715/790 |
| 2007/0113198 | A1 * | 5/2007 | Robertson et al. | 715/790 |
| 2007/0126732 | A1 * | 6/2007 | Robertson et al. | 345/419 |
| 2012/0030569 | A1 * | 2/2012 | Migos et al. | 715/702 |

OTHER PUBLICATIONS

Ben Willmore, "Adobe Photoshop CS2 Studio Techniques", Adobe Press, Aug. 17, 2005.*
Ben Willmore, "Adobe Photoshop CS2 Studio Techniques", Publish: Adobe Press, Aug. 17, 2005.*

* cited by examiner

*Primary Examiner* — David T. Welch
*Assistant Examiner* — Jin Ge
(74) *Attorney, Agent, or Firm* — Patterson & Sheridan, LLP

(57) ABSTRACT

A technique for manipulating the layering order of graphical objects in a digital canvas or document is disclosed. A graphics object that is included in a layer in the digital canvas or document is selected. The digital canvas or document is searched in order to define a subset of graphics objects that includes the selected graphics object and any other graphics objects that overlap with the selected graphics object. A layering-order control enables a user to move the layer associated with the selected graphics object to a depth in the digital canvas or document that includes a layer associated with one of the other graphics objects in the subset of graphics objects. The concurrent re-positioning of multiple layers associated with two or more selected graphics objects is also disclosed.

16 Claims, 5 Drawing Sheets

SYSTEM AND METHOD FOR INTUITIVE MANIPULATION OF THE LAYERING ORDER OF GRAPHICS OBJECTS

BACKGROUND OF THE INVENTION

1. Field of the Invention

The invention relates generally to graphics rendering and, more specifically, to a system and method for intuitive manipulation of the layering order of graphics objects.

2. Description of the Related Art

In conventional two-dimensional computer graphics, layered modeling produces a target image by painting overlapping layers on a digital canvas or document in the order of decreasing depth. Many applications employ layered modeling techniques to render graphics objects in a digital canvas or document. For example, Microsoft Powerpoint and Adobe Photoshop both employ layers to allow users to create and manipulate graphics objects.

With these applications, a user typically changes the layering order of graphics objects by adjusting the absolute depth of the layer containing the graphics object the user wants to reorder. One approach used for adjusting the absolute depth of layers requires a user to first select a graphics object and then use a menu to change the depth of the layer associated with the graphics object. For example, a user of Powerpoint or other Microsoft Office applications must first select the graphics object and then use a textual list that is part of the right-click menu to change the absolute depth of the layer associated with the selected graphics object. The textual list of commands includes commands that change the absolute depth of the layer by one position, such as Bring Forward and Send Backward, as well as commands that move the layer to the absolute top or bottom of all layers in the document, such as Bring to Front and Send to Back.

Another approach used for adjusting the absolute depth of layers requires a user to change the absolute depth of a layer by dragging a layer up or down in a layer palette tool. For example, Photoshop and the GNU Image Manipulation Program (GIMP) employ a layer palette tool for manipulating the absolute depth of layers in composite images. The layer palette tool displays graphical thumbnails that represent each of the individual layers in the canvas. The user changes the absolute depth of a layer by dragging the thumbnail representing the selected layer above or below the layer immediately adjacent to the selected layer.

One drawback to these approaches is that when two overlapping graphics objects are associated with different layers that have a large disparity in the absolute depth of the digital canvas or document, the user may be required to repeat a command multiple times before the two graphics objects switch relative positions in the layering order. For example, a user may have to select the Bring Forward command five times in order to move a layer up five positions in absolute depth, or a user may have to drag a layer up five positions in the user palette tool to move the layer up five positions in absolute depth. Furthermore, when two non-overlapping graphics objects switch relative position in the layering order, the rendered display of the digital canvas or document remains the same. Therefore, the user may be confused as to whether any layers have actually changed position in the absolute depth in the digital canvas or document.

As the foregoing illustrates, what is needed in the art is an improved approach for manipulating the layering order of graphics objects in a digital canvas or document.

SUMMARY OF THE INVENTION

One embodiment of the present invention sets forth a computer-implemented method for manipulating a layering order of graphics objects in a digital canvas or document comprised of a plurality of layers, where each layer is located at a different depth in the digital canvas or document. The method includes the steps of defining a subset of the graphics objects in the digital canvas or document that includes a first graphics object associated with a first layer located at a first depth in the digital canvas or document and any other graphics object in the digital canvas or document that overlaps with the first graphics object, and, in response to a reordering command that specifies a second layer located at a second depth in the digital canvas or document and is associated with at least one other graphics object in the subset of graphics objects, moving the first layer to the second depth in the digital canvas or document.

One advantage of the above approach is that the reordering command moves the selected graphics object above or below at least one other graphics object in a defined subset of graphics objects. Thus, even if there is a large disparity in absolute depth between the selected graphics object and the other graphics object in the defined subset of graphics objects, a single reordering command moves the selected graphics object above or below the other graphics object in the digital canvas or document while simultaneously moving the selected graphics object above or below any intervening layers in the digital canvas or document. Furthermore, because every manipulation based on a reordering command results in two overlapping graphics objects changing relative positions in absolute depth in the digital canvas or document, the rendered display of the digital canvas or document is changed in response to the reordering command, thereby allowing an end-user to clearly see and understand the changes he or she is making in the digital canvas or document.

BRIEF DESCRIPTION OF THE DRAWINGS

So that the manner in which the above recited features of the invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

In the following description, numerous specific details are set forth to provide a more thorough understanding of the invention. However, it will be apparent to one of skill in the art that the invention may be practiced without one or more of these specific details. In other instances, well-known features have not been described in order to avoid obscuring the invention.

Figure 1:
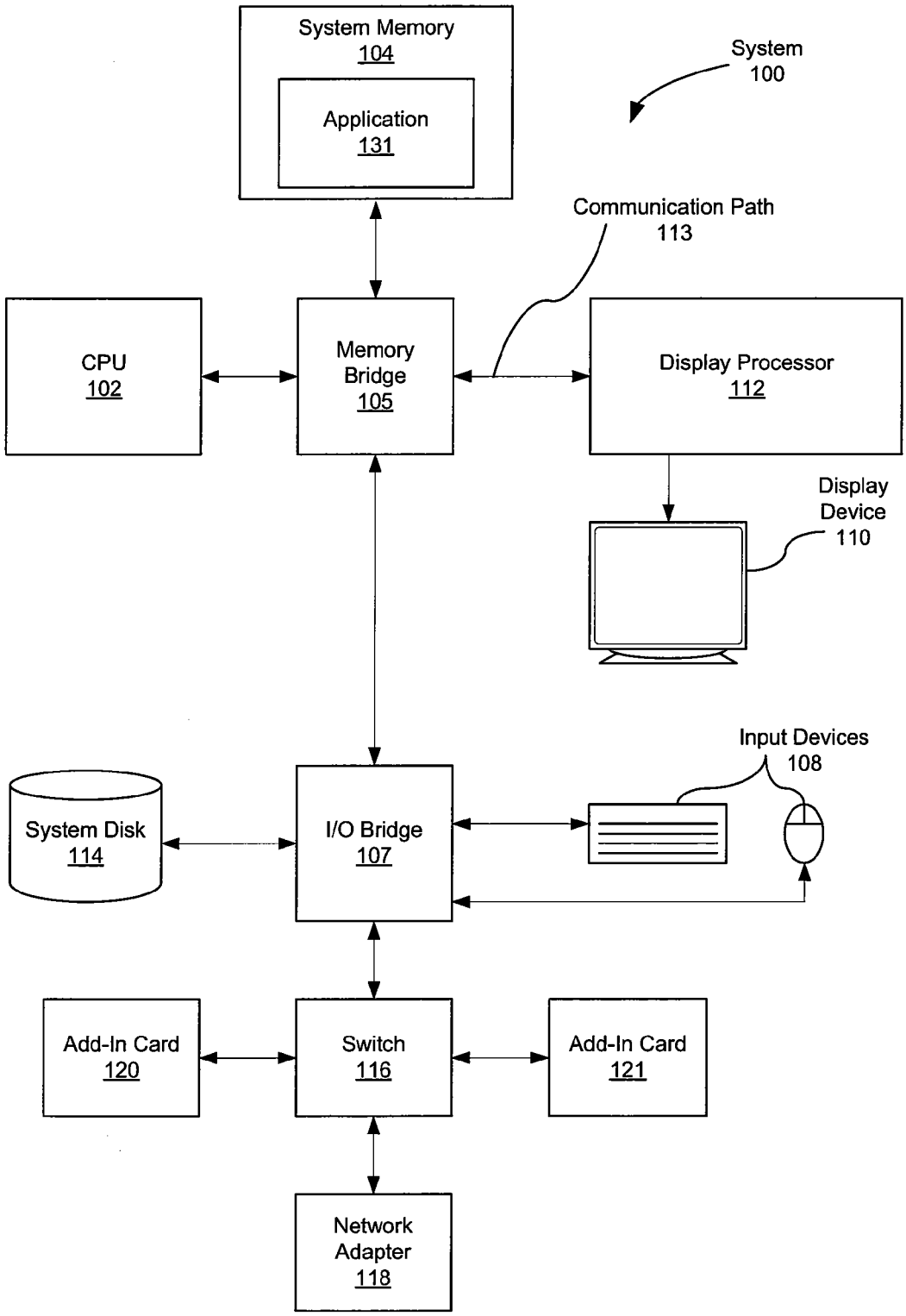
FIG. 1 is a block diagram of a system configured to implement one or more aspects of the invention.

FIG. 1 is a block diagram of a system 100 configured to implement one or more aspects of the invention. System 100 may be a computer workstation, personal computer, video game console, personal digital assistant, rendering engine, mobile phone, hand held device, smart phone, super-smart phone, or any other device suitable for practicing one or more embodiments of the present invention.

As shown, system 100 includes one or more processing units, such as central processing unit (CPU) 102, and a system memory 104 communicating via a bus path that may include a memory bridge 105. CPU 102 includes one or more processing cores, and, in operation, CPU 102 is the master processor of system 100, controlling and coordinating operations of other system components. System memory 104 stores software applications and data for use by CPU 102. CPU 102 runs software applications and optionally an operating system. Memory bridge 105, which may be, e.g., a Northbridge chip, is connected via a bus or other communication path (e.g., a HyperTransport link) to an I/O (input/output) bridge 107. I/O bridge 107, which may be, e.g., a Southbridge chip, receives user input from one or more user input devices 108 (e.g., keyboard, mouse, joystick, digitizer tablets, touch pads, touch screens, still or video cameras, motion sensors, and/or microphones) and forwards the input to CPU 102 via memory bridge 105.

One or more display processors, such as display processor 112, are coupled to memory bridge 105 via a bus or other communication path (e.g., a PCI Express, Accelerated Graphics Port, or HyperTransport link); in one embodiment display processor 112 is a graphics subsystem that includes at least one graphics processing unit (GPU) and graphics memory. Graphics memory includes a display memory (e.g., a frame buffer) used for storing pixel data for each pixel of an output image. Graphics memory can be integrated in the same device as the GPU, connected as a separate device with the GPU, and/or implemented within system memory 104.

Display processor 112 periodically delivers pixels to a display device 110 (e.g., a screen or conventional CRT, plasma, OLED, SED or LCD based monitor or television). Additionally, display processor 112 may output pixels to film recorders adapted to reproduce computer generated images on photographic film. Display processor 112 can provide display device 110 with an analog or digital signal.

A system disk 114 is also connected to I/O bridge 107 and may be configured to store content and applications and data for use by CPU 102 and display processor 112. System disk 114 provides non-volatile storage for applications and data and may include fixed or removable hard disk drives, flash memory devices, and CD-ROM, DVD-ROM, Blu-ray, HD-DVD, or other magnetic, optical, or solid state storage devices.

A switch 116 provides connections between I/O bridge 107 and other components such as a network adapter 118 and various add-in cards 120 and 121. Network adapter 118 allows system 100 to communicate with other systems via an electronic communications network, and may include wired or wireless communication over local area networks and wide area networks such as the Internet.

Other components (not shown), including USB or other port connections, film recording devices, and the like, may also be connected to I/O bridge 107. For example, an audio processor may be used to generate analog or digital audio output from instructions and/or data provided by CPU 102, system memory 104, or system disk 114. Communication paths interconnecting the various components in FIG. 1 may be implemented using any suitable protocols, such as PCI (Peripheral Component Interconnect), PCI Express (PCI-E), AGP (Accelerated Graphics Port), HyperTransport, or any other bus or point-to-point communication protocol(s), and connections between different devices may use different protocols, as is known in the art.

In one embodiment, display processor 112 incorporates circuitry optimized for graphics and video processing, including, for example, video output circuitry, and constitutes a graphics processing unit (GPU). In another embodiment, display processor 112 incorporates circuitry optimized for general purpose processing. In yet another embodiment, display processor 112 may be integrated with one or more other system elements, such as the memory bridge 105, CPU 102, and I/O bridge 107 to form a system on chip (SoC). In still further embodiments, display processor 112 is omitted and software executed by CPU 102 performs the functions of display processor 112.

Pixel data can be provided to display processor 112 directly from CPU 102. In some embodiments of the present invention, instructions and/or data representing a scene are provided to a render farm or a set of server computers, each similar to system 100, via network adapter 118 or system disk 114. The render farm generates one or more rendered images of the scene using the provided instructions and/or data. These rendered images may be stored on computer-readable media in a digital format and optionally returned to system 100 for display. Similarly, stereo image pairs processed by display processor 112 may be output to other systems for display, stored in system disk 114, or stored on computer-readable media in a digital format.

Alternatively, CPU 102 provides display processor 112 with data and/or instructions defining the desired output images, from which display processor 112 generates the pixel data of one or more output images, including characterizing and/or adjusting the offset between stereo image pairs. The data and/or instructions defining the desired output images can be stored in system memory 104 or graphics memory within display processor 112. In an embodiment, display processor 112 includes 3D rendering capabilities for generating pixel data for output images from instructions and data defining the geometry, lighting shading, texturing, motion, and/or camera parameters for a scene. Display processor 112 can further include one or more programmable execution units capable of executing shader programs, tone mapping programs, and the like.

In one embodiment, application 131 is stored in system memory 104. Application 131 may be any application that when executed on CPU 102 allows users to select and manipulate graphics objects in a document or canvas, such as Adobe Photoshop or GIMP. In alternative embodiments, application 131 may be a Web application, such as a Flash program, that is stored on a remote server and accessed through network adapter 118.

It will be appreciated that the system shown herein is illustrative and that variations and modifications are possible.

The connection topology, including the number and arrangement of bridges, may be modified as desired. For instance, in some embodiments, system memory 104 may be connected to CPU 102 directly rather than through a bridge, and other devices may communicate with system memory 104 via memory bridge 105 and CPU 102. In other alternative topologies display processor 112 may be connected to I/O bridge 107 or directly to CPU 102, rather than to memory bridge 105. In still other embodiments, I/O bridge 107 and memory bridge 105 may be integrated in a single chip. In addition, the particular components shown herein are optional. For instance, any number of add-in cards or peripheral devices might be supported. In some embodiments, switch 116 is eliminated, and network adapter 118 and add-in cards 120, 121 connect directly to I/O bridge 107.

Figure 2A:
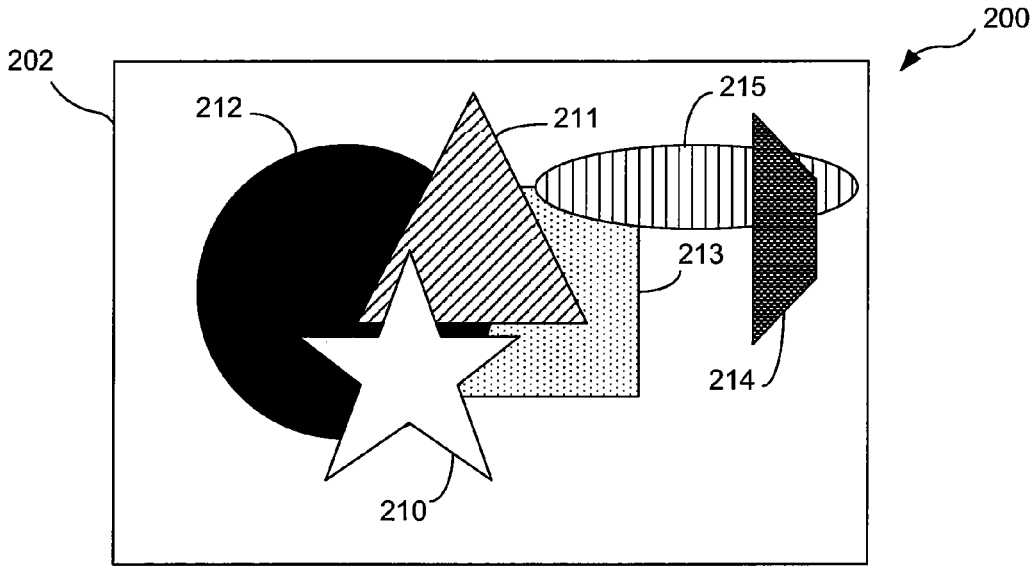
FIG. 2A illustrates a graphics application environment that includes a layered ordering of graphics objects, according to one embodiment of the invention.

FIG. 2A illustrates a graphics application environment 200 that includes a layered ordering of graphics objects, according to one embodiment of the invention. In various embodiments, the graphics application environment 200 may be implemented via application 131 or via some other application executing within system 100. As shown, graphics application environment 200 generates a digital canvas 202 that includes graphics objects 210, 211, 212, 213, 214, and 215. In one embodiment, graphics application environment 200 generates layers that are ordered in the absolute depth in the digital canvas 202. For example, digital canvas 202 includes six layers, each layer is located at an absolute depth in the digital canvas 202 ranging between 0 and 5.

Each graphics object included in digital canvas 202 is associated with a distinct layer in digital canvas 202. For example, graphics object 210 is associated with the layer located at absolute depth 0, graphics object 214 is associated with the layer located at absolute depth 1, graphics object 211 is associated with the layer located at absolute depth 2, graphics object 212 is associated with the layer located at absolute depth 3, graphics object 215 is associated with the layer located at absolute depth 4, and graphics object 213 is associated with the layer located at absolute depth 5. In one embodiment, each layer may be associated with one or more graphics objects. In alternative embodiments, each layer may only be associated with a single graphics object. As described in further detail herein, a user may adjust the layering order of a subset of the graphics objects included in digital canvas 202 to effect changes in the positions of the graphics objects in the subset of graphics objects relative to one another independently of the other graphics objects in the digital canvas 202.

Figure 2B:
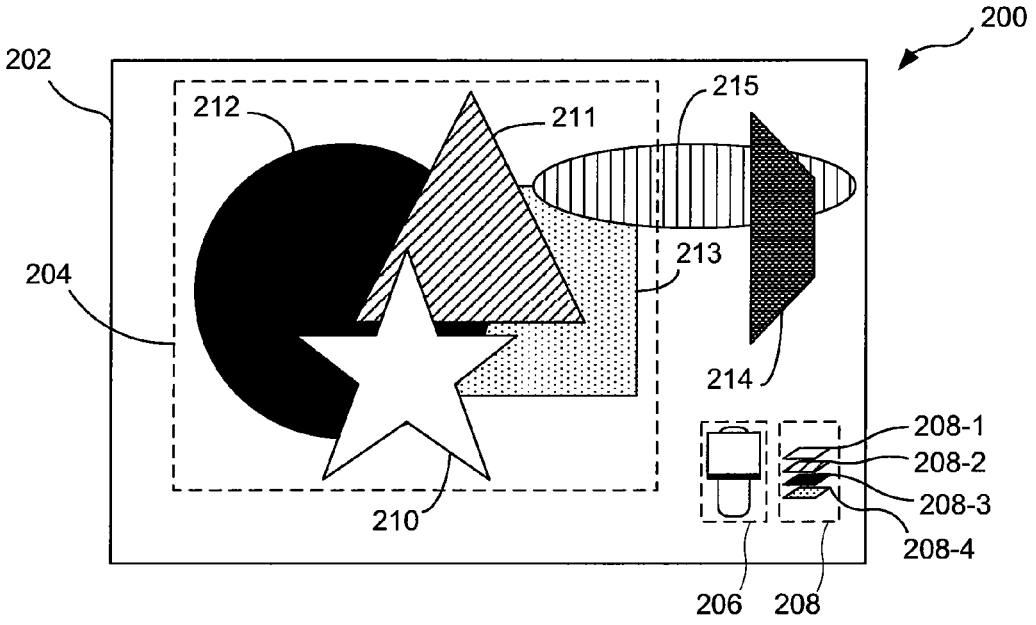
FIG. 2B illustrates the graphics application environment of FIG. 2A with a graphics object having been selected, according to one embodiment of the invention, to adjust the layering order of a subset of graphics objects included in the digital canvas.

FIG. 2B illustrates the graphics application environment 200 of FIG. 2A with a graphics object 210 having been selected, according to one embodiment of the invention, to adjust the layering order of a subset of graphics objects 204 included in the digital canvas 202. As shown, when graphics object 210 is selected, graphics application environment 200 defines a subset of graphics objects 204 that includes the selected graphics object 210 as well as any other graphics objects included in the digital canvas 202 that overlap with the selected graphics object 210. Thus, the defined subset of graphics objects 204 includes graphics objects 210, 211, 212 and 213 and excludes graphics objects 214 and 215. The graphics objects in the defined subset of graphics objects 204 are associated with a subset of layers in the digital canvas 202 (referred to herein as "subset layers"). (Also, layers in the digital canvas 202 not associated with a graphics object in the defined subset of graphics objects are sometimes referred to as "non-subset layers.") Thus, in the example of FIG. 2B, the subset layers are the layers associated with graphics objects 210, 211, 212, and 213. As described in further detail herein, each subset layer is located at a distinct absolute depth in the digital canvas 202. Here, the subset layers are the layers located at absolute depths 0, 2, 3, and 5.

In one embodiment, graphics application environment 200 determines whether two graphics objects overlap by generating a bounding box around each of the graphics objects and then comparing the bounding boxes, such as by comparing the pixel locations of the upper left and lower right corners of the bounding boxes, to determine whether the bounding boxes intersect. In alternative embodiments, graphics application environment 200 may use rendering techniques to determine whether two graphics objects overlap. For example, by rendering each graphics object in a separate frame, graphics application environment 200 may compare the pixel locations in the separate frames in order to determine whether the graphics objects overlap. In yet other embodiments, graphics application environment 200 may determine whether two graphics objects overlap in a two-stage process. In a first stage, graphics application 200 determines if the two graphics objects overlap using the bounding box technique described above, and then, if the bounding boxes intersect, proceeds to a second stage where the graphics application environment 200 implements a pixel based technique, such as the rendering technique described above. In this manner, graphics application environment 200 limits use of the computationally expensive pixel based approach to only those graphics objects that could overlap based on an intersection of the associated bounding boxes. It will be appreciated that graphics application environment 200 may implement any technically feasible technique for determining whether two graphics objects overlap and that all such techniques are within the scope of the invention.

As also shown in FIG. 2B, graphics application environment 200 displays a layering-order control 206 and a stacking-order indicator 208 superimposed over the digital canvas 202 to enable a user to adjust the layering order of the subset layers in digital canvas 202. In one embodiment, layering-order control 206 is configured with a number of discrete control positions that is equal to the total number of subset layers in the digital canvas 202. Each discrete control position of layering-order control 206 corresponds to a different subset layer in the digital canvas 202. For example, layering-order control 206 has four discrete control positions. The first discrete control position corresponds to the subset layer associated with selected graphics object 210, the second discrete control position corresponds to the subset layer associated with graphics object 211, the third discrete control position corresponds to the subset layer associated with graphics object 212, and the fourth discrete control position corresponds to the subset layer associated with graphics object 213. Further, each discrete control position of layering-order control 206 is associated with the absolute depth of the subset layer corresponding to that position. Thus, the four discrete control positions of layering-order control 206 are associated with the absolute depths 0, 2, 3, and 5 in the digital canvas 202, respectively. In alternative embodiments, layering-order control 206 is configured as an analog control, where the current position of layering-order control 206 is mapped to a number of discrete control positions that is equal to the total number of subset layers in the digital canvas 202. For example, in the case where layering-order control 206 has a current position given as a value between 0 and 1, a first range of the current position corresponds to a first subset layer, a second range of the current position corresponds to a second subset layer, etc.

In one embodiment, stacking-order indicator 208 is a graphical depiction of the relative layering order of the subset layers in the digital canvas 202. For example, stacking-order indicator 208 includes four layer icons 208-1, 208-2, 208-3, and 208-4. Layer icon 208-1 indicates the relative position of the subset layer associated with graphics object 210, layer icon 208-2 indicates the relative position of the subset layer associated with graphics object 211, layer icon 208-3 indicates the relative position of the subset layer associated with graphics object 212, and layer icon 208-4 indicates the relative position of the subset layer associated with graphics object 213. As a user adjusts layering-order control 206, reordering the subset layers in the digital canvas 202, the layer icons in stacking-order indicator 208 also change relative position to reflect the new relative layering order of the subset layers. For example, if the subset layer associated with selected graphics object 210 is initially located at absolute depth 0, and the subset layer associated with graphics object 211 is initially located at absolute depth 1, and a user adjusts layering-order control 206, moving the subset layer associated with selected graphics object 210 to a new location at absolute depth 1, and moving the subset layer associated with graphics object 211 to a new location at absolute depth 0, then, layer icon 208-1 would move from the first position of stacking-order indicator 208 to the second position of stacking-order indicator 208. Likewise, layer icon 208-2 would move from the second position of stacking-order indicator 208 to the first position of stacking-order indicator 208. Thus, layer icon 208-1 and layer icon 208-2 would change relative positions in stacking-order indicator 208 to reflect the new relative layering order of the subset layers.

In addition, the layer icons included in stacking-order indicator 208 are color coordinated to visually distinguish between the different subset layers associated with the different graphics objects in the defined subset of graphics objects 204. For example, layer icon 208-1 is white corresponding to a color associated with the subset layer associated with selected graphics object 210. Layer icons 208-2, 208-3, and 208-4 are other different colors corresponding to the different colors associated with the different subset layers in the digital canvas 202. In alternative embodiments, layer icons 208-1, 208-2, 208-3, and 208-4 may implement other ways, such as using textual descriptions, to distinguish between the different subset layers in digital canvas 202.

As the foregoing illustrates, graphics application environment 200 provides the user with three visual cues in order to indicate the relative layering order of the subset layers in digital canvas 202. First, digital canvas 202 is displayed with selected graphics object 210 shown in context with all overlapping graphics objects. Second, the position of layering-order control 206 communicates the position of the subset layer associated with selected graphics object 210 relative to the other subset layers in the digital canvas 202. In the example of FIG. 2B, the layering-order control is initially set to a first discrete control position that indicates the subset layer that includes the selected graphics object 210 is located above the other subset layers in the digital canvas 202. Finally, stacking-order indicator 208 communicates the relative layering order of the subset layers in the digital canvas 202. Again, in the example of FIG. 2B, stacking-order indicator 208 indicates that the subset layer that includes the selected graphics object 210 is positioned above the other subset layers in the digital canvas 202 because the layer icon 208-1 is above layer icons 208-2, 208-3, and 208-4 (which correspond to the other subset layers in the digital canvas 202) and colored to match the color of the selected graphics object 210, which is the graphics object on "top" of the other graphics objects in the defined subset of graphics objects 204.

Figure 2C:
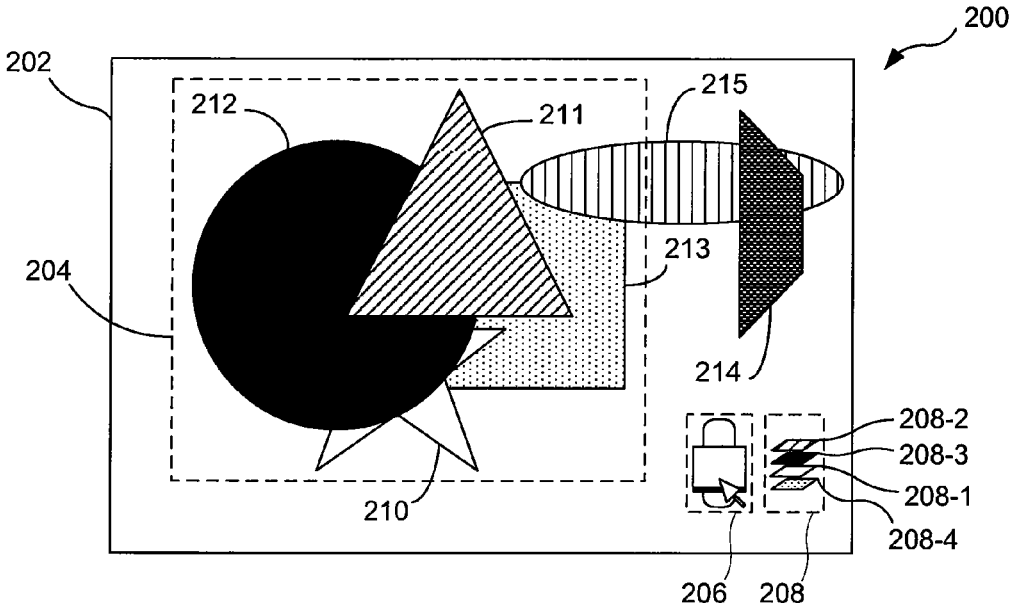
FIG. 2C illustrates the graphics application environment, of FIG. 2B, where, according to one embodiment of the invention, the layering order of the graphics objects in the subset of graphics objects has been adjusted.

FIG. 2C illustrates the graphics application environment 200 of FIG. 2B, where, according to one embodiment of the invention, the relative layering order of the subset layers has been adjusted. Again, layering-order control 206 is used to adjust the relative layering order of the subset layers in the digital canvas 202. Again, as shown in FIG. 2B, layering-order control 206 is initially set to a first discrete control position that corresponds to the subset layer associated with selected graphics object 210 and is associated with absolute depth 0 in the digital canvas 202. When a user adjusts layering-order control 206 from the first discrete control position to a third discrete control position, graphics application environment 200 moves the subset layer associated with selected graphics object 210 to the absolute depth in the digital canvas 202 associated with the third discrete control position of layering-order control 206. Graphics application environment 200 may make room for the subset layer associated with selected graphics object 210 at the absolute depth in digital canvas 202 associated with the third discrete control position of layering-order control 206 in various ways as illustrated in FIGS. 3A, 3B, and 3C, described below.

As also shown in the example of FIG. 2C, the layer icons of stacking-order indicator 208 are repositioned relative to one another to reflect the new relative layering order of the subset layers in the digital canvas 202. Layer icon 208-1 is repositioned because the subset layer associated with graphics object 210 is now located below the subset layers associated with graphics objects 211 and 212. For example, layer icon 208-2 is located at the top of stacking-order indicator 208 because the subset layer associated with graphics object 211 is the subset layer at the highest depth in the digital canvas 202 (absolute depth 0), layer icon 208-3 is located below layer icon 208-2 because the subset layer associated with graphics object 212 is below the subset layer associated with graphics object 211 (absolute depth 2 is below absolute depth 0), layer icon 208-1 is located below layer icon 208-3 because the subset layer associated with selected graphics object 210 is below the subset layer associated with graphics object 212 (absolute depth 3 is below absolute depth 2), and layer icon 208-4 is located below layer icon 208-1 because the subset layer associated with graphics object 213 is below the subset layer associated with selected graphics object 210 (absolute depth 5 is below absolute depth 3).

Figure 3A:
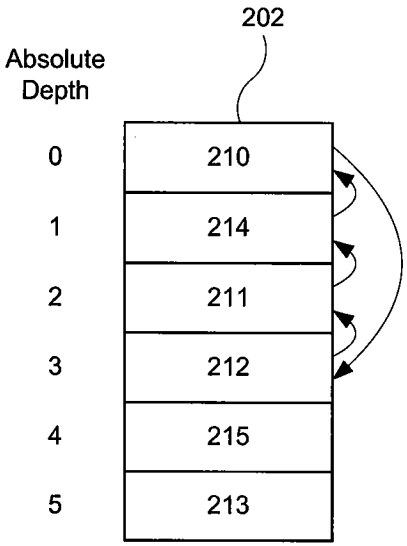
FIG. 3A illustrates one implementation of how the layers in a digital canvas or document may be reordered, according to one embodiment of the invention.

FIG. 3A illustrates one implementation of how the layers in a digital canvas or document may be reordered, according to one embodiment of the invention. In this implementation, when a user adjusts layering-order control 206 from an initial discrete control position to an adjusted discrete control position, graphics application environment 200 adjusts the absolute depth of all subset layers and non-subset layers located between the absolute depth associated with the initial discrete control position and the absolute depth associated with the adjusted discrete control position, as well as the subset layer located at the absolute depth associated with the adjusted discrete control position, to make room at the absolute depth associated with the adjusted discrete control position for the subset layer associated with the selected graphics object 210. For example, as shown in FIG. 3A, graphics application environment 200 moves the non-subset layer associated with graphics object 214 from absolute depth 1 to absolute depth 0, the subset layer associated with graphics object 211 from absolute depth 2 to absolute depth 1, the subset layer associated with graphics object 212 from absolute depth 3 to absolute depth 2, and the subset layer associated with selected graphics object 210 from absolute depth 0 to absolute depth 3 in the digital canvas 202.

Figure 3B:
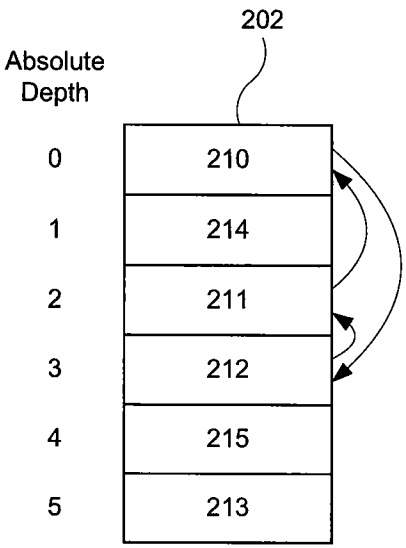
FIG. 3B illustrates another implementation of how the layers in a digital canvas or document may be reordered, according to one embodiment of the invention.
Figure 3C:
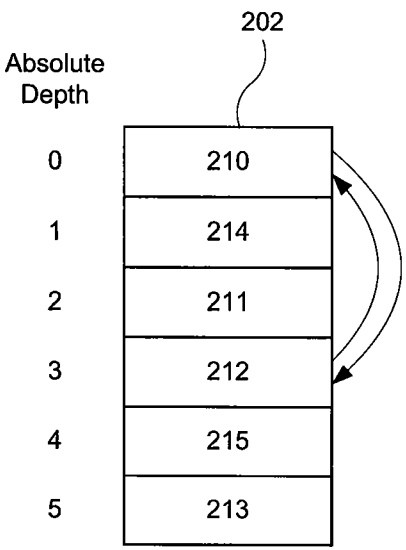
FIG. 3C illustrates yet another implementation of how the layers in a digital canvas or document may be reordered, according to one embodiment of the invention.

FIG. 3B illustrates another implementation of how the layers in a digital canvas or document may be reordered, according to one embodiment of the invention. In this implementation, when a user adjusts layering-order control 206 from an initial discrete control position to an adjusted discrete control position, graphics application environment 200 adjusts the absolute depth of all subset layers located between the absolute depth associated with the initial discrete control position and the absolute depth associated with the adjusted discrete control position, as well as the subset layer located at the absolute depth associated with the adjusted discrete control position, to make room at the absolute depth associated with the adjusted discrete control position for the subset layer associated with the selected graphics object 210. In contrast to the implementation described above with reference to FIG. 3A, graphics application environment 200 does not move any intervening non-subset layers in the digital canvas 202. For example, as shown in FIG. 3B, graphics application environment 200 moves the subset layer associated with graphics object 211 from absolute depth 2 to absolute depth 0, the subset layer associated with graphics object 212 from absolute depth 3 to absolute depth 2, and the subset layer associated with graphics object 210 from absolute depth 0 to absolute depth 3 in the digital canvas 202. Thus, only subset layers are moved in the digital canvas 202, not non-subset layers.

FIG. 3C illustrates yet another implementation of how the layers in a digital canvas or document may be reordered, according to one embodiment of the invention. In this implementation, when a user adjusts layering-order control 206 from an initial discrete control position to an adjusted discrete control position, graphics application environment 200 only adjusts the absolute depth of the subset layer that corresponds to the adjusted discrete control position to make room at the absolute depth associated with the adjusted discrete control position for the subset layer associated with the selected graphics object 210. For example, as shown in FIG. 3C, graphics application environment 200 moves the subset layer associated with graphics object 212 from absolute depth 3 to absolute depth 0, and the subset layer associated with graphics object 210 from absolute depth 0 to absolute depth 3 in the digital canvas 202.

The three implementations described above in FIGS. 3A, 3B, and 3C regarding different ways of moving the layers in the digital canvas or document are exemplary methods for reordering subset layers in the digital canvas or document. Persons skilled in the art will appreciate that all other techniques known in the art may be implemented in the above system and that these different implementations are within the scope of the present invention.

It will also be appreciated that the system described above with respect to a single selected graphics object may also be implemented with multiple selected graphics objects. In one embodiment, graphics application environment 200 may select more than one graphics object in digital canvas 202. The defined subset of graphics objects 204 would then include the two or more selected graphics objects as well as all graphics objects in digital canvas 202 that overlap with at least one of the two or more selected graphics objects. For example with reference to FIG. 2A, if graphics application environment 200 could select both graphics object 210 and graphics object 214, then the defined subset of graphics objects 204 would include graphics objects 210, 211, 212, 213, 214, and 215. Layering-order control 206 would have six discrete control positions, and, for each manipulation of layering-order control 206, at least one of the subset layers associated with selected graphics object 210 or 214 would change position relative to another subset layer in the digital canvas 202.

Figure 4:
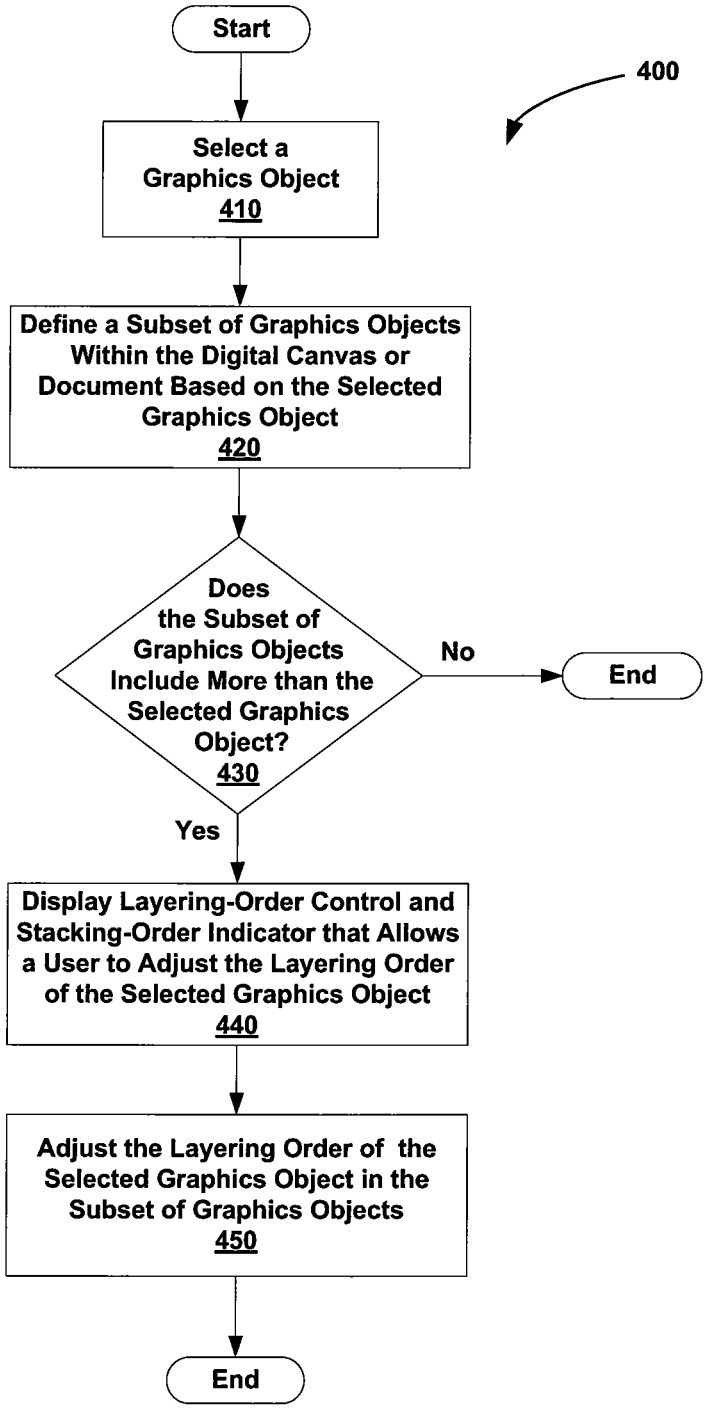
FIG. 4 is a flow diagram of method steps for manipulating the layering order of graphics objects within a digital canvas or document, according to one embodiment of the invention.

FIG. 4 is a flow diagram of method steps 400 for manipulating the layering order of layers within a digital canvas or document, according to one embodiment of the invention. Although the method steps are described in conjunction with the systems of FIGS. 1, 2A, 2B and 2C, persons skilled in the art will understand that any system configured to perform the method steps, in any order, is within the scope of the invention.

As shown, the method 400 begins at step 410, where graphics application environment 200 selects a graphics object 210 included in the digital canvas 202. For example, graphics application environment 200 could select the graphics object 210 in response to one or more signals from input devices 108, such as a keyboard, a multi-touch display, or a computer mouse. At step 420, graphics application environment 200 defines a subset of graphics objects 204 in the digital canvas 202. The subset of graphics objects 204 includes the selected graphics object 210 and any additional graphics objects in the digital canvas 202 that overlap with the selected graphics object 210. Again, in one embodiment, graphics application environment 200 determines whether any additional graphics objects overlap the selected graphics object 210 by comparing bounding boxes generated about each additional graphics object with a bounding box generated around the selected graphics object 210. In alternative embodiments, graphics application environment 200 may determine whether any additional graphics objects overlap the selected graphics object 210 using rendering techniques.

At step 430, graphics application environment 200 determines whether the defined subset of graphics objects 204 includes more than the selected graphics object 210. If the defined subset of graphics objects 204 includes only the selected graphics object 210, then no other graphics objects in the digital canvas 202 overlap with the selected graphics object 210 and the method terminates. However, if the defined subset of graphics objects 204 includes more than the selected graphics object 210, then at least one other graphics object in the digital canvas 202 overlaps with the selected graphics object 210, and the method proceeds to step 440.

At step 440, graphics application environment 200 displays layering-order control 206 and stacking-order indicator 208 superimposed over the digital canvas 202. A user may adjust the layering order of subset layers in the digital canvas 202 by manipulating layering-order control 206. At step 450, graphics application environment 200 adjusts the layering order of the subset layers in the digital canvas 202. In one embodiment, the user adjusts layering-order control 206 to change the absolute depth of the subset layer associated with selected graphics object 210. Graphics application environment 200 moves the subset layer associated with selected graphics object 210 to the absolute depth in the digital canvas 202 associated with the adjusted discrete control position of layering-order control 206. Various other subset layers and non-subset layers in the digital canvas 202 are also moved in order to reposition the subset layer associated with selected graphics object 210 at the new location in the absolute depth of the digital canvas 202.

It will be appreciated that the rendered display of the digital canvas or document changes when a first subset layer is repositioned relative to a second subset layer in the absolute depth in the digital canvas 202. Users typically only adjust the layering order of subset layers relative to other subset layers because adjusting the layering order of non-subset layers relative to other subset layers has no effect on the rendered display of the digital canvas or document. Thus, by limiting the reordering commands in the digital canvas or document to only reorder subset layers relative to other subset layers, the graphics application environment 200 may greatly reduce the granularity of tools used for manipulation of the layering order of the subset layers in the digital canvas or document.

In sum, the approach described above provides a mechanism for manipulating the layering order of graphics objects within a digital canvas or document. More specifically, when a graphics object is selected, a subset of graphics objects is defined that includes the selected graphics object as well as all graphics objects in the digital canvas or document that overlap with the selected graphics object. A subset of layers in the digital canvas or document is associated with the subset of graphics objects, where each individual subset layer is associated with one or more of the graphics objects in the subset of graphics objects.

A layering-order control enables a user to manipulate the relative positions or order of the subset layers in the digital canvas or document. The layering-order control includes a number of discrete control positions equal to the number of subset layers, where each discrete control position corresponds to a different subset layer in the digital canvas or document. For example, the first discrete control position could correspond to the subset layer at the highest absolute depth in the digital canvas or document, the second discrete control position could correspond to the subset layer at the second highest absolute depth in the digital canvas or document, etc. Upon selecting the graphics object in the digital canvas or document and defining the subset of graphics objects, an initial discrete control position of the layering-order control corresponds to the subset layer associated with the selected graphics object. When a user selects an adjusted discrete control position of the layering-order control, the subset layer associated with the selected graphics object is moved to the absolute depth associated with the adjusted discrete control position. The other subset layers are moved as needed to make room for the subset layer associated with the selected graphics object.

In one implementation, to make room for the subset layer associated with the selected graphics object, each subset layer and non-subset layer positioned between the absolute depth associated with the initial discrete control position and the absolute depth associated with the adjusted discrete control position, as well as the subset layer located at the absolute depth associated with the adjusted discrete control position, is "moved up" (meaning the absolute depth of the layer is decreased) or "moved down" (meaning the absolute depth of the layer is increased) one position towards the absolute depth associated with the initial discrete control position.

In another implementation, to make room for the subset layer associated with the selected graphics object, each subset layer positioned between the absolute depth associated with the initial discrete control position and the absolute depth associated with the adjusted discrete control position, as well as the subset layer positioned at the absolute depth associated with the adjusted discrete control position, is "moved up" (meaning the absolute depth of the subset layer is decreased) or "moved down" (meaning the absolute depth of the subset layer is increased) one relative subset layer position towards the relative subset layer position corresponding to the initial discrete control position. For each subset layer that is moved, the absolute depth of the subset layer is changed to reflect the absolute depth in the digital canvas or document corresponding to the relative subset layer position to which the subset layer is moved.

In yet another implementation, to make room for the subset layer associated with the selected graphics object, the subset layer located at an absolute depth associated with the adjusted discrete control position and the subset layer located at an absolute depth associated with the initial discrete control position are switched in the absolute depth in the digital canvas or document. The subset layer located at an absolute depth associated with the adjusted discrete control position is moved to the absolute depth associated with the initial discrete control position. Likewise, the subset layer located at an absolute depth associated with the initial discrete control position is moved to the absolute depth associated with the adjusted discrete control position.

One advantage of the above approach is that the reordering command moves the selected graphics object above or below at least one other graphics object in a defined subset of graphics objects. Thus, even if there is a large disparity in absolute depth between the selected graphics object and the other graphics object in the defined subset of graphics objects, a single reordering command moves the selected graphics object above or below the other graphics object in the digital canvas or document while simultaneously moving the selected graphics object above or below any intervening layers in the digital canvas or document. Furthermore, because every manipulation based on a reordering command results in two overlapping graphics objects changing relative positions in absolute depth in the digital canvas or document, the rendered display of the digital canvas or document is changed in response to the reordering command, thereby allowing an end-user to clearly see and understand the changes he or she is making in the digital canvas or document.

While the foregoing is directed to embodiments of the present invention, other and further embodiments of the present invention may be devised without departing from the basic scope thereof. For example, aspects of the present invention may be implemented in hardware or software or in a combination of hardware and software. One embodiment of the present invention may be implemented as a program product for use with a computer system. The program(s) of the program product define functions of the embodiments (including the methods described herein) and can be contained on a variety of computer-readable storage media. Illustrative computer-readable storage media include, but are not limited to: (i) non-writable storage media (e.g., read-only memory devices within a computer such as CD-ROM disks readable by a CD-ROM drive, flash memory, ROM chips or any type of solid-state non-volatile semiconductor memory) on which information is permanently stored; and (ii) writable storage media (e.g., floppy disks within a diskette drive or hard-disk drive or any type of solid-state random-access semiconductor memory) on which alterable information is stored. Such computer-readable storage media, when carrying computer-readable instructions that direct the functions of the present invention, are embodiments of the present invention.

In view of the foregoing, the scope of the present invention is determined by the claims that follow.

What is claimed is:

1. A computer-implemented method for manipulating a layering order of graphics objects in a digital canvas or document comprised of a plurality of layers, the method comprising:

defining a subset of the graphics objects in the digital canvas or document that includes a first graphics object associated with a first layer located at a first depth in the digital canvas or document and any other graphics object in the digital canvas or document that overlaps with the first graphics object; and in response to a reordering command specifying a second layer that is located at a second depth in the digital canvas or document and is associated with at least one other graphics object in the subset, moving: (i) the first layer to the second depth in the digital canvas or document, (ii) each layer that includes a graphics object in the subset and that is located at a respective depth within an inclusive range defined by the first depth and the second depth towards the first depth to a next closest location in depth at which another layer that includes a graphics object in the subset is located, and (iii) the second layer towards the first depth to a next location in depth at which another layer that includes a graphics object in the subset is located, wherein the reordering command does not move a third layer that includes a graphics object that is not in the subset and is located at a depth between the first depth and the second depth, wherein the reordering command is generated responsive to changing a position of a selectable layering-order control from a first position to a second position, of a plurality of positions of the selectable layering-order control.

2. The method of claim 1, wherein the selectable layering-order control is not one of the graphics objects and is an interactive graphical interface element displayed in the digital canvas or document, wherein the selectable layering-order control does not display identification information for the plurality of layers and the subset in the digital canvas or document.

3. The method of claim 2, further comprising:

updating a stacking-order indicator to reflect a relative layering order of the plurality of layers in the digital canvas or document, wherein the stacking-order indicator is configured to depict the second layer at the first depth, wherein one or more layer icons in the stacking-order indicator are color coordinated to visually distinguish between the plurality of layers.

4. The method of claim 3, wherein another graphics object in the digital canvas or document overlaps with the first graphics object if at least one pixel location covered by the first graphics object is the same as a pixel location covered by the another graphics object.

5. The method of claim 4, wherein another graphics object in the digital canvas or document overlaps with the first graphics object if at least a portion of a bounding box generated for the first graphics object intersects at least a portion of a bounding box generated for the another graphics object.

6. The method of claim 5, wherein each position of the selectable layering-order control corresponds to a layer associated with at least one graphics object in the subset, wherein a number of the plurality of positions of the selectable layering-order control are equal to a number of the plurality of layers including at least one of the subset, and wherein the reordering command indicating the layer corresponding to the second position of the selectable layering-order control, the method further comprising:

responsive to the reordering command, updating each position of the selectable layering-order control to correspond to the relative layering order of each of the plurality of layers in the digital canvas or document.

7. The method of claim 6, wherein the subset further includes a second graphics object and any other graphics object in the digital canvas or document that overlaps with the second graphics object.

8. A non-transitory computer readable storage medium, storing instructions that when executed by a processor, cause the processor to manipulate a layering order of graphics objects in a digital canvas or document comprised of a plurality of layers, by performing the steps of:

defining a subset of the graphics objects in the digital canvas or document that includes a first graphics object associated with a first layer located at a first depth in the digital canvas or document and any other graphics object in the digital canvas or document that overlaps with the first graphics object; and in response to a reordering command specifying a second layer that is located at a second depth in the digital canvas or document and is associated with at least one other graphics object in the subset, moving: (i) the first layer to the second depth in the digital canvas or document, (ii) each layer that includes a graphics object in the subset and that is located at a respective depth within an inclusive range defined by the first depth and the second depth towards the first depth to a next closest location in depth at which another layer that includes a graphics object in the subset is located, and (iii) the second layer towards the first depth to a next location in depth at which another layer that includes a graphics object in the subset is located, wherein the reordering command does not move a third layer that includes a graphics object that is not in the subset and is located at a depth between the first depth and the second depth, wherein the reordering command is generated responsive to changing a position of a selectable layering-order control from a first position to a second position, of a plurality of positions of the selectable layering-order control.

9. The computer readable storage medium of claim 8, wherein the selectable layering-order control is not one of the graphics objects and is an interactive graphical interface element displayed in the digital canvas or document, wherein the selectable layering-order control does not display identification information for the plurality of layers and the subset in the digital canvas or document.

10. The computer readable storage medium of claim 9, wherein another graphics object in the digital canvas or document overlaps with the first graphics object if at least one pixel location covered by the first graphics object is the same as a pixel location covered by the another graphics object.

11. The computer readable storage medium of claim 10, wherein another graphics object in the digital canvas or document overlaps with the first graphics object if at least a portion of a bounding box generated for the first graphics object intersects at least a portion of a bounding box generated for the another graphics object.

12. The computer readable storage medium of claim 11, wherein a current position of the layering-order control is mapped to a number of discrete control positions that is equal to a number of the plurality of layers including at least one graphics object of the subset, and wherein the reordering command indicating the layer corresponding to the second position of the selectable layering-order control.

13. The computer readable storage medium of claim 12, wherein the subset further includes a second graphics object and any other graphics object in the digital canvas or document that overlaps with the second graphics object.

14. A system for manipulating a layering order of graphics objects in a digital canvas or document comprised of a plurality of layers, the system comprising:

a memory; and a processor coupled to the memory, wherein the processor is configured to:

define a subset of the graphics objects in the digital canvas or document that includes a first graphics object associated with a first layer located at a first depth in the digital canvas or document and any other graphics object in the digital canvas or document that overlaps with the first graphics object, and in response to a reordering command specifying a second layer that is located at a second depth in the digital canvas or document and is associated with at least one other graphics object in the subset, move: (i) the first layer to the second depth in the digital canvas or document, (ii) each layer that includes a graphics object in the subset and that is located at a respective depth within an inclusive range defined by the first depth and the second depth towards the first depth to a next closest location in depth at which another layer that includes a graphics object in the subset is located, and (iii) the second layer towards the first depth to a next location in depth at which another layer that includes a graphics object in the subset is located, wherein the reordering command does not move a third layer that includes a graphics object that is not in the subset and is located at a depth between the first depth and the second depth, wherein the reordering command is generated responsive to changing a position of a selectable layering-order control from a first position to a second position, of a plurality of positions of the selectable layering-order control.

15. The system of claim 14, wherein the selectable layering-order control is not one of the graphics objects and is an interactive graphical interface element displayed in the digital canvas or document, wherein the selectable layering-order control does not display identification information for the plurality of layers and the subset in the digital canvas or document.

16. The system of claim 15, wherein the selectable layering-order control has a plurality of positions, each position corresponding to a layer associated with at least one graphics object in the subset, and the reordering command indicating the layer corresponding to the second position of the selectable layering-order control.

* * * * *